United States Patent [19]

Buhler

[11] 4,277,916

[45] Jul. 14, 1981

[54] LENS CHUCKING APPARATUS

[75] Inventor: Rato R. Buhler, Dudley, Mass.

[73] Assignee: American Optical Corporation, Southbridge, Mass.

[21] Appl. No.: 130,286

[22] Filed: Mar. 14, 1980

[51] Int. Cl.[3] ..... B24B 13/00

[52] U.S. Cl. ..... 51/217 L

[58] Field of Search ..... 51/216 R, 216 LP, 217 R, 51/217 L

[56] References Cited

U.S. PATENT DOCUMENTS

| | | | |
|---|---|---|---|
| 1,436,626 | 11/1922 | Spaander | 51/217 L |
| 2,573,668 | 10/1951 | Long | 51/217 L |
| 3,079,736 | 5/1963 | Kratt | 51/217 L |

FOREIGN PATENT DOCUMENTS

| | | | |
|---|---|---|---|
| 630402 | 10/1949 | United Kingdom | 51/216 LP |
| 1463508 | 2/1977 | United Kingdom | 51/216 LP |

*Primary Examiner*—Harold D. Whitehead

*Attorney, Agent, or Firm*—Alan H. Spencer

[57] ABSTRACT

Manufacturing prismatic ophthalmic lenses by setting prism angle at the time of chucking for surface generation. The lens is secured to a block having a spherical edge insertable into a correspondingly internally spherical collet against adjustable stops for setting prism angle. Closing of the collet against the block fixes the lens for surface generation.

7 Claims, 3 Drawing Figures

LENS CHUCKING APPARATUS

BACKGROUND OF THE INVENTION

1. Field of the Invention

Manufacturing prismatic ophthalmic lenses with particular reference to improvements in lens chucking apparatus.

2. Description of the Prior Art

The introduction of prism in ophthalmic lens surfacing operations has, heretofore, required that a lens be blocked at the needed prism angle prior to attachment to the surfacing apparatus or that a squarely blocked lens be tilted in a surfacing machine chuck with wedges and the like. Illustrations of the former may be found in U.S. Pat. Nos. 3,118,198; 3,195,197; 3,866,667 and U.S. Pat. No. 3,490,182 illustrates a blocking scheme using spacers of differing thicknesses for prism adjustment.

Considerable tediousness and much wasted time is experienced in conventional prism blocking procedures and/or wedging in chucks for the many different prism settings encountered in the field.

Accordingly, it is an object of the present invention to simplify and accelerate the manufacture of prismatic ophthalmic lenses and, more particularly, to simplify lens blocking and chucking for prism surfacing operations.

Other objects and advantages of the invention will become apparent from the following description.

SUMMARY OF THE INVENTION

Objectives of the invention are accomplished by setting lens prism angle at the time of chucking for surface generation. The lens in each case is mounted squarely upon a block having a spherical edge which is insertable into a correspondingly internally spherical collet. This permits angular adjustment of the blocked lens in all directions relative to the collet axis.

Upon insertion of the block, prism angle and direction is automatically established with stops located internally of the collet and against which the block is seated.

Correct rotational orientation of the lens relative to a setting of the stops is accomplished with an interfitting pin and slot, one in the collet and the other in the block and tightening of the collet against the block readies the lens for surfacing.

Details of the invention will be better understood from the following description when taken in conjunction with the accompanying drawings.

IN THE DRAWINGS

DESCRIPTION OF THE PREFERRED EMBODIMENTS

According to the present invention, a lens L (FIG. 1) to be prismatically surface generated is mounted squarely upon a block B having a spherical edge 10 which is fitted into a collet 12 having an internally spherically shaped block receiving seat 14.

Block B may be formed of molded and/or machined metal, plastic or other rigid material to which lens L is attached with a suitable pitch or other adhesive. Alternatively, block B may comprise a low melting temperature metallic alloy which is cast directly upon lens L. Those interested in details of the latter may refer to U.S. Pat. Nos. 3,118,198; 3,195,197; and 3,866,667.

Figure 3:
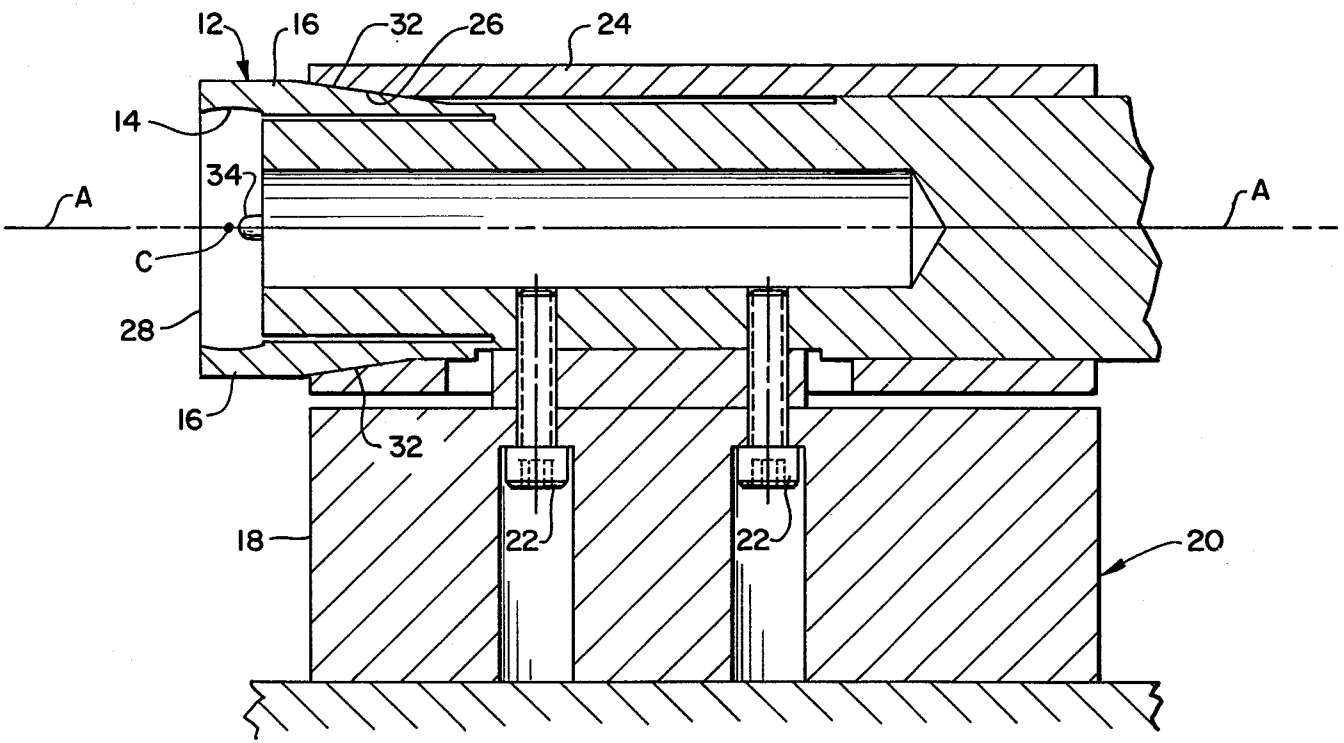
FIG. 3 is a fragmentary cross-section taken approximately along line 3—3 of FIG. 1 with the lens and lens block removed for clarity of illustration.

Spherical seat 14 in collet 12 is formed internally of its split worked-receiving end, i.e. in spring fingers 16, and fingers 16 are spring-biased away from each other toward an open collet position. Collet 12 is fixed to work supporting head 18 of surfacing apparatus 20, e.g. with studs 22 (FIG. 3), and surrounded by actuating sleeve 24 having internal taper 26. A sliding of sleeve 24 along collet 12 toward and away from the working end 28 of the collet effects closing and opening of fingers 16, the latter permitting insertion of block B and the former allowing removal and replacement of block B. Sleeve 24 may be operated by one or more hydraulic or pneumatic cylinders 30 (FIG. 1) or any other means desired by the artisan.

With closing of the fingers 16 over block B by moving taper 26 of sleeve 24 over the outer taper 32 of fingers 16, the spherical edge 10 of block B and correspondingly shaped seat 14 permit tilting of the block in collet 12 relative to collet axis A—A about the common center of curvature C of seat 14 and block edge 10. Adjustable stops 34 establish the degree and direction of tilting of block B.

Figure 1:
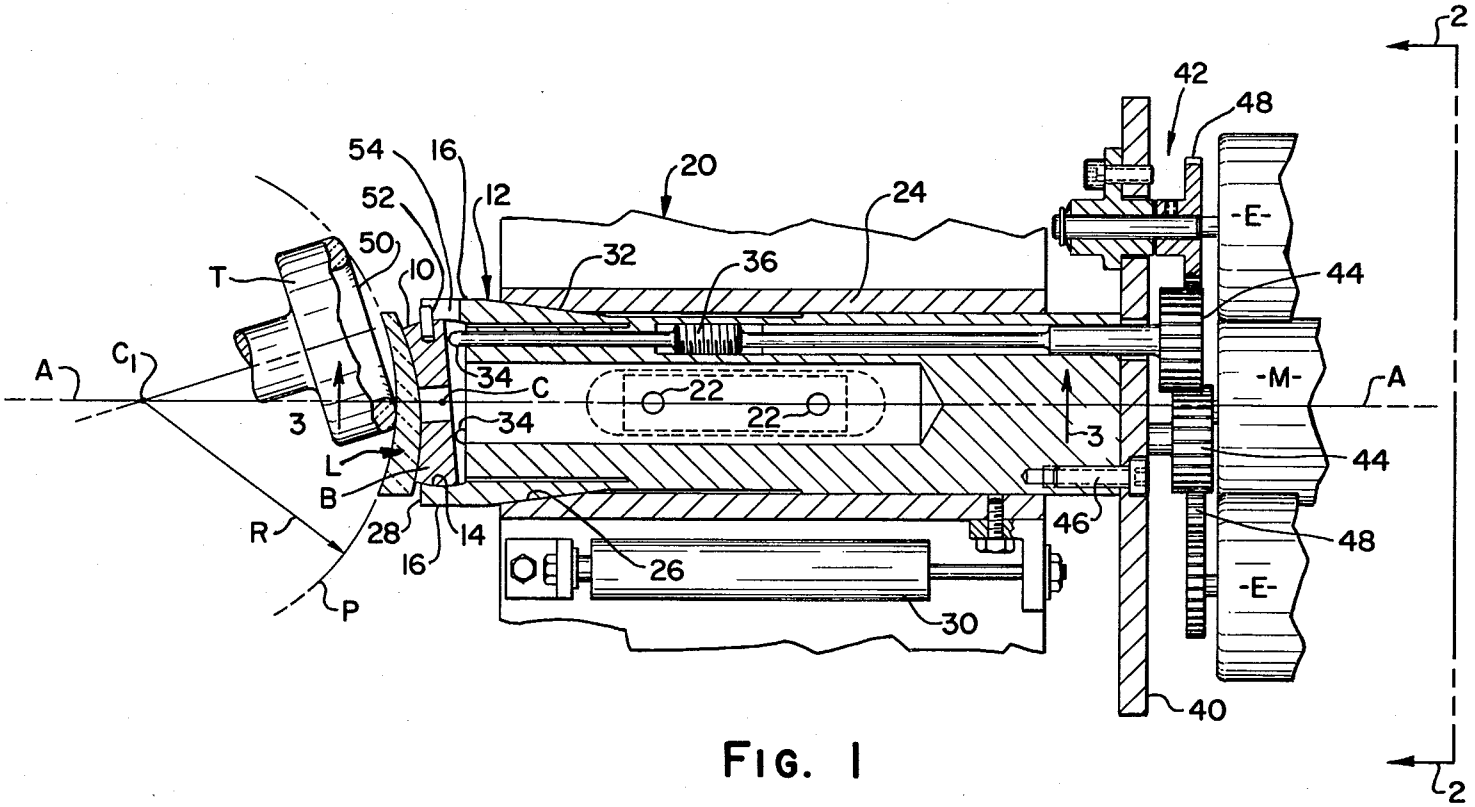
FIG. 1 is a cross-sectioned illustration of lens surfacing apparatus incorporating an embodiment of the present invention.
Figure 2:
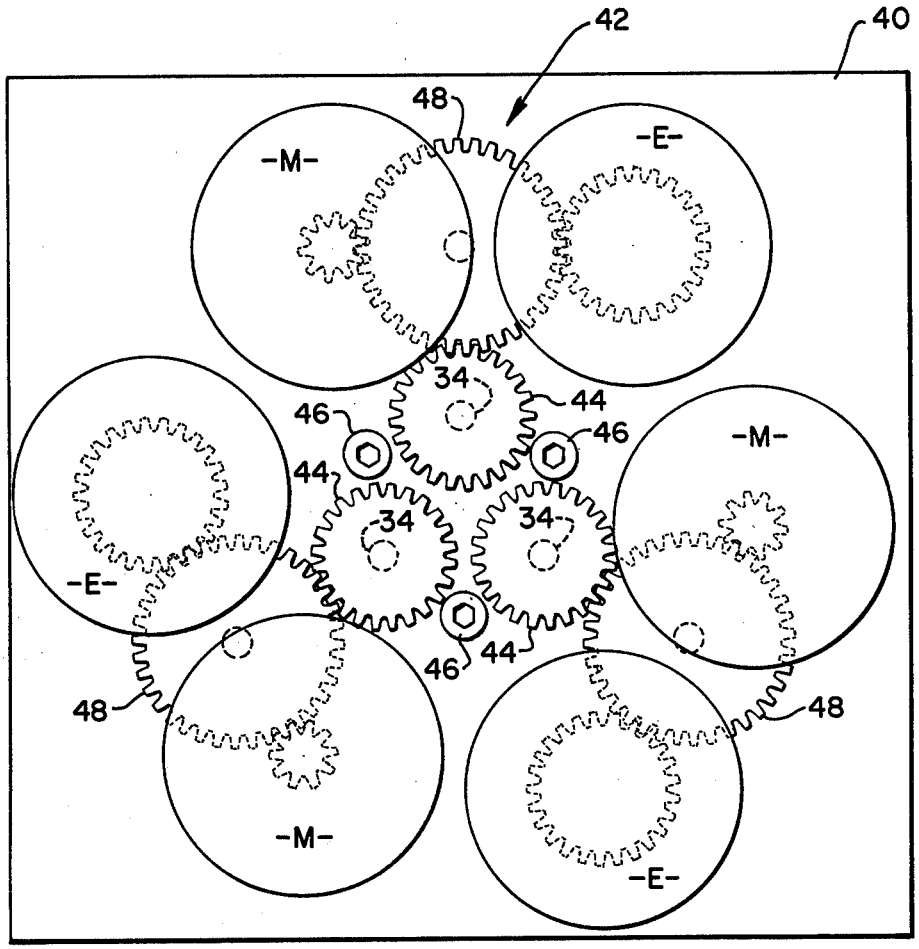
FIG. 2 is an end view of the apparatus of FIG. 1 looking in the direction of the arrows of line 2—2.

As presently illustrated, stops 34 comprise three equiangularly disposed and equally radially spaced rods which are longitudinally adjustable in collet 12 with threading 36 (FIG. 1).

Beyond the requirement for accurate predetermined setting of stops 34 according to prism angle desired to be generated in lens L, the choice of means for accomplishing same is immaterial to the invention. It is preferred, however, that stops 34 be driven with computer signal encoding which may be accomplished as follows:

Each of stops 34 extends through plate 40 which supports drive mechanism 42. Plate 40 is secured to collet 12 with screws 46 and each of stops 34 are terminated with a gear 44.

In mesh with each of gears 44 is an idler gear 48 which, in turn, is driven by a motor M. The operation of motors M may be controlled by any suitable means, e.g. encoders E geared to idlers 48.

Once a block B is adjusted for desired prism angle by seating against stops 34, the block is clamped for lens L surfacing by closing fingers 16 of collet 12 with sleeve 24.

With lens L tilted relative to collet axis A—A by the amount of block B adjustment, a prism angle corresponding to the resulting tilt of lens L may be generated with conventional on-axis lens surfacing apparatus. For example, a cupped lens grinding tool T may be swept across lens L in a curved path P having its center of curvature $C_1$ on axis A—A. The radius of curvature R of path P will determine the generated surface radius in one meridian thereof and the angle of presentation of abrading face 50 of tool T will establish the radius of generated curvature in a meridian normal to the one meridian.

Those interested in details of the above technique for generating spherical and toric surface curvatures may refer to U.S. Pat. Nos. 3,118,198 and 3,152,427. Lens generating operations using preformed tools as in U.S. Pat. Nos. 3,117,396 and 3,624,969 may also be used. There is, however, the requirement that prism correction in a lens be oriented in a prescribed direction relative to a particular meridian of the lens, e.g. the cylinder meridian of a toric lens. Accordingly, locating pin 52 in block B and receiving slot 54 in collet 12 are provided to fix the rotational orientation of lens L in apparatus 20. In the present illustration, pin 52 and slot 54 are disposed in the meridian of sweep of tool T about path P. Slot 54 may, however, be located in others of the fingers 16.

The universal (all directional) adjustment of block B which is afforded by the spherical block edge 10 and collet seat 14 permits the selection of any desired lens prism angle and direction relative to the direction of sweep of tool T. The selected direction and degree of prism angle is finally established by the setting of stops 34. Those interested in details of prior art lens prism angle orientation and generation may refer to U.S. Pat. Nos. 3,152,427; 3,118,198; and 3,866,667.

From the foregoing it can be seen that this invention simplifies and provides for acceleration of the manufacture of prismatic ophthalmic lenses. It should be appreciated, however, that various modifications and adaptations of the precise form of the invention here shown and described may be made to suit particular requirements. Accordingly, it is intended that all modifications which incorporate the disclosed concept are to be construed as coming within the scope of the following claims or the range of equivalency to which they are entitled.

I claim:

1. In lens surfacing apparatus, the combination comprising:

a lens block having one side to which a lens may be attached and a spherically contoured edge;

a collet for chucking said block, said collet having a plurality of laterally outwardly biased spring fingers adjacent a work-receiving end thereof, said fingers collectively having an internal spherical seat adjacent said work-receiving end of said collet for intimately receiving said edge of said block when placed therein, said spherical edge of said block and sphericity of said seat being of substantially corresponding curvatures permitting universal tilting adjustment of said block relative to a central axis of said collet;

means for selectively effecting an outwardly directed opening and inwardly directed closing of said spring fingers for respectively seating said block in said seat and ultimately clamping same therein; and stop means comprising elongated adjustable elements internally of said working end of said collet for establishing a fixed angular adjustment of said block in said collet seat by engagement with a side of said block oppositely of said lens attachment side.

2. Lens surfacing apparatus according to claim 1 including a locating pin and slot, one in said work receiving end of said collet and the other in said edge of said block for fixedly rotationally orienting said block and attached lens in said collet seat.

3. Lens surfacing apparatus according to claim 2 wherein said pin is in said block and said slot is in one of said spring fingers of said collet.

4. Lens surfacing apparatus according to claim 1 wherein outer portions of said spring fingers of said collet are collectively tapered inwardly in a direction away from said work-receiving end of said collet and an internal taper of a collet closing sleeve is adapted to be moved over said outer portions of said spring fingers for effecting said inward closing of said fingers.

5. Lens surfacing apparatus according to claim 1 wherein said stop means includes a plurality of rods in said collet each extending parallel to said central axis of said collet into said work-receiving end, said rods being individually longitudinally adjustable toward and away from said work-receiving end for establishing said angular adjustment of said block in said collet seat.

6. Lens surfacing apparatus according to claim 5 wherein said rods are three in number and are disposed substantially equiangularly about said central axis of said collet at substantially equal distances from said axis.

7. Lens surfacing apparatus according to claim 5 including means for adjusting said rods toward and away from said work-receiving end of said collet.

* * * * *